United States Patent [19]

Cleland

[11] Patent Number: 4,517,079

[45] Date of Patent: May 14, 1985

[54] ORE SEPARATION SYSTEM

[76] Inventor: Keith B. Cleland, 3189 Industrial Dr., Yuba City, Calif. 95991

[21] Appl. No.: 539,716

[22] Filed: Oct. 6, 1983

[51] Int. Cl.[3] ..... B03B 5/74

[52] U.S. Cl. ..... 209/452; 209/444

[58] Field of Search ..... 209/444, 450, 451, 452

[56] References Cited

U.S. PATENT DOCUMENTS

| | | | |
|---|---|---|---|
| 1,041,909 | 10/1912 | Trent | 209/451 |
| 1,216,118 | 2/1917 | Hering | 209/444 |
| 1,983,457 | 12/1934 | Hering | 209/444 |
| 1,986,778 | 1/1935 | Hinkley | 209/452 |
| 2,155,587 | 4/1939 | Fairbank | 209/451 X |
| 4,008,152 | 2/1977 | Kleven | 209/444 |
| 4,110,206 | 8/1978 | Kleven | 209/444 X |
| 4,312,749 | 1/1982 | Bingham | 209/452 X |
| 4,389,308 | 6/1983 | Cleland | 209/444 |
| 4,406,783 | 9/1983 | Cleland | 209/444 |

FOREIGN PATENT DOCUMENTS

| | | | |
|---|---|---|---|
| 846154 | 8/1960 | United Kingdom | 209/451 |

*Primary Examiner*—Robert Spitzer

*Attorney, Agent, or Firm*—William W. Haefliger

[57] ABSTRACT

Ore separating rotary bowls are combined in staggered, closely spaced relation to facilitate efficient use and transportation.

21 Claims, 12 Drawing Figures

ORE SEPARATION SYSTEM

BACKGROUND OF THE INVENTION

This invention relates generally to ore separation, and more particularly to efficient separation systems and processes.

In ore concentrators of the type shown in U.S. Pat. No. 1,986,778 to Hinkley, the number of leads employed on the rotating bowl was between about five and ten, so that the size of the center hole to which material is led was minimal. Accordingly, hollow bowl rotating shafts could be used to conduct the material from the center hole and away from the bowl.

However, when the size of the machine increased significantly, the number of leads in the bowl increased to between 60 and 100, for example. As a consequence, the size of the central opening and of the hollow shaft increased markedly, and to the point where undesirably large shaft bearings and associated apparatus would be required.

U.S. Pat. No. 4,389,303 to Cleland overcomes such problems, and discloses solid rotating shafts for the bowls, characterized by their design for the structural integrity of the system versus a transporting characteristic for concentrates. Accordingly, the need for large size hollow shafts is eliminated. However, structure at the rear of the bowl used for tilting same precluded such close grouping of such bowls as is now made possible by the present invention, and which substantially increases separation efficiencies as well as enables ready portability of such multiple bowl systems.

SUMMARY OF THE INVENTION

It is a major object of the present invention to provide simple, highly effective and improved apparatus overcoming the above problems and difficulties. Basically, the invention comprises:

(a) first and second rotary bowls each having rotary surfaces for separating particles of ore received into the bowls, each bowl having an axis of rotation, the bowls mounted for selective and independent tilting of said axes, both bowls facing generally frontwardly, (b) the second bowl having an open interior portion thereof openly facing toward a portion of the rear of the first bowl, with said axes offset from one another, the bowls located in closely spaced relation with the first bowl having a rearward discharge opening in particle discharge communication with said open interior portion of the second bowl.

Further, the fore and aft spacing between the bowls may be less than the diameter of the second bowl, whereby the first bowl may directly discharge into the second bowl; a third and smaller bowl may be provided aft of the second bowl to rotate about an axis extending generally sidewardly, whereby all three bowls are readily adapted for transportation as a unit; and the drives for at least the first and also preferably the second bowls may include peripheral drive rollers and supports therefore which accommodate close spacing of the multiple bowls and their relative tilting.

These and other objects and advantages of the invention, as well as the details of an illustrative embodiment, will be more fully understood from the following description and drawings, in which:

DRAWING DESCRIPTION

FIG. 1 is front perspective view of ore separator apparatus as disclosed in U.S. Pat. No. 4,389,303;

DETAILED DESCRIPTION

Figure 4:
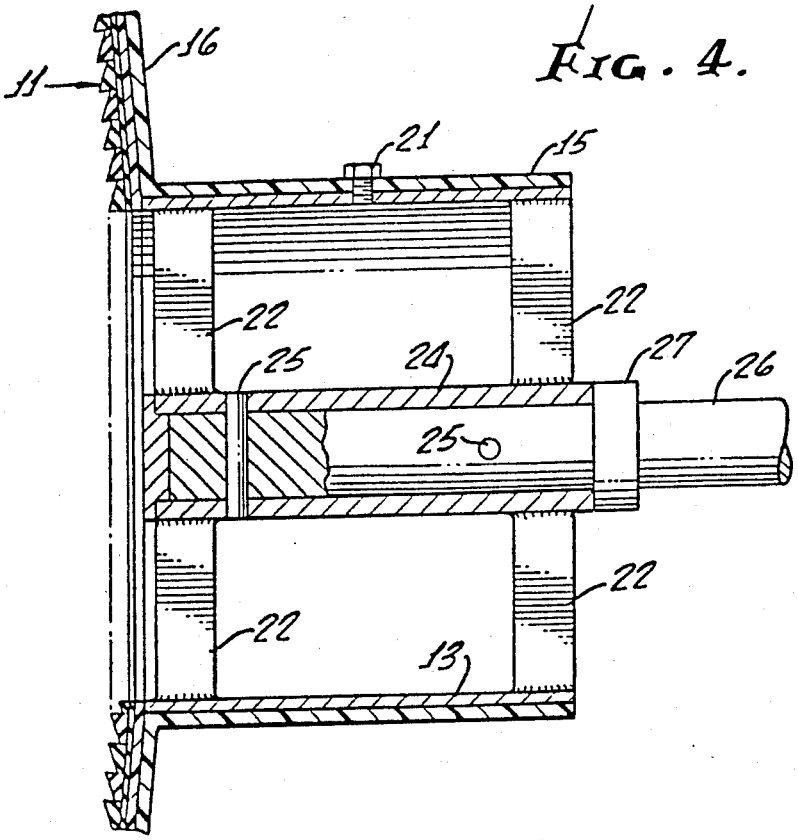
FIG. 4 is a cross-sectional view of the FIG. 1 apparatus assembled hub, drive shaft, and a portion of the bowl.
Figure 5:
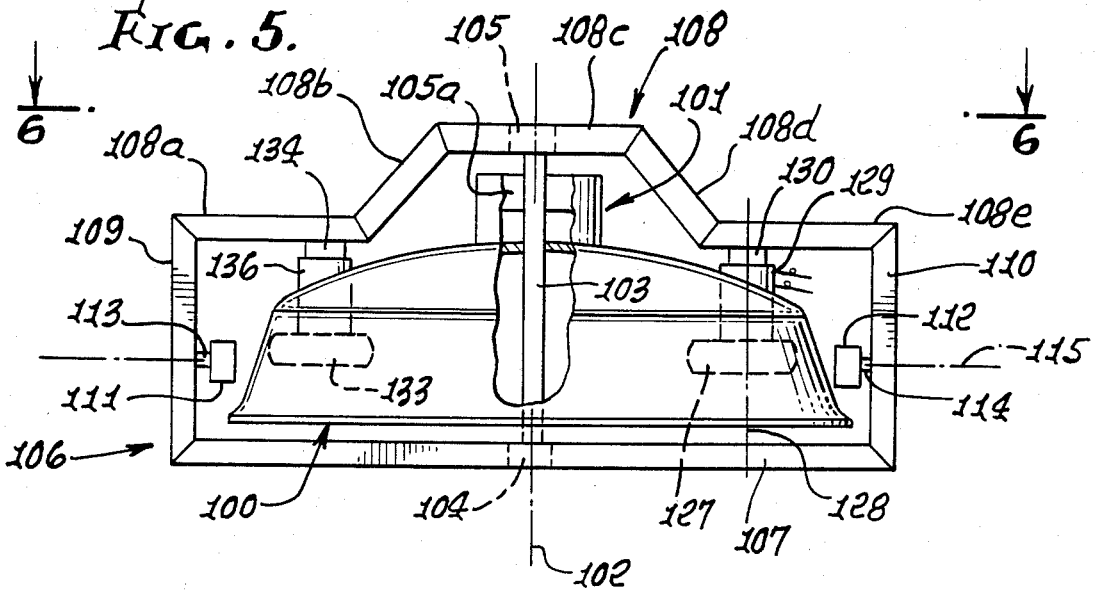
FIG. 5 is a top plan view of bowl support and drive apparatus in accordance with the present invention.
Figure 6:
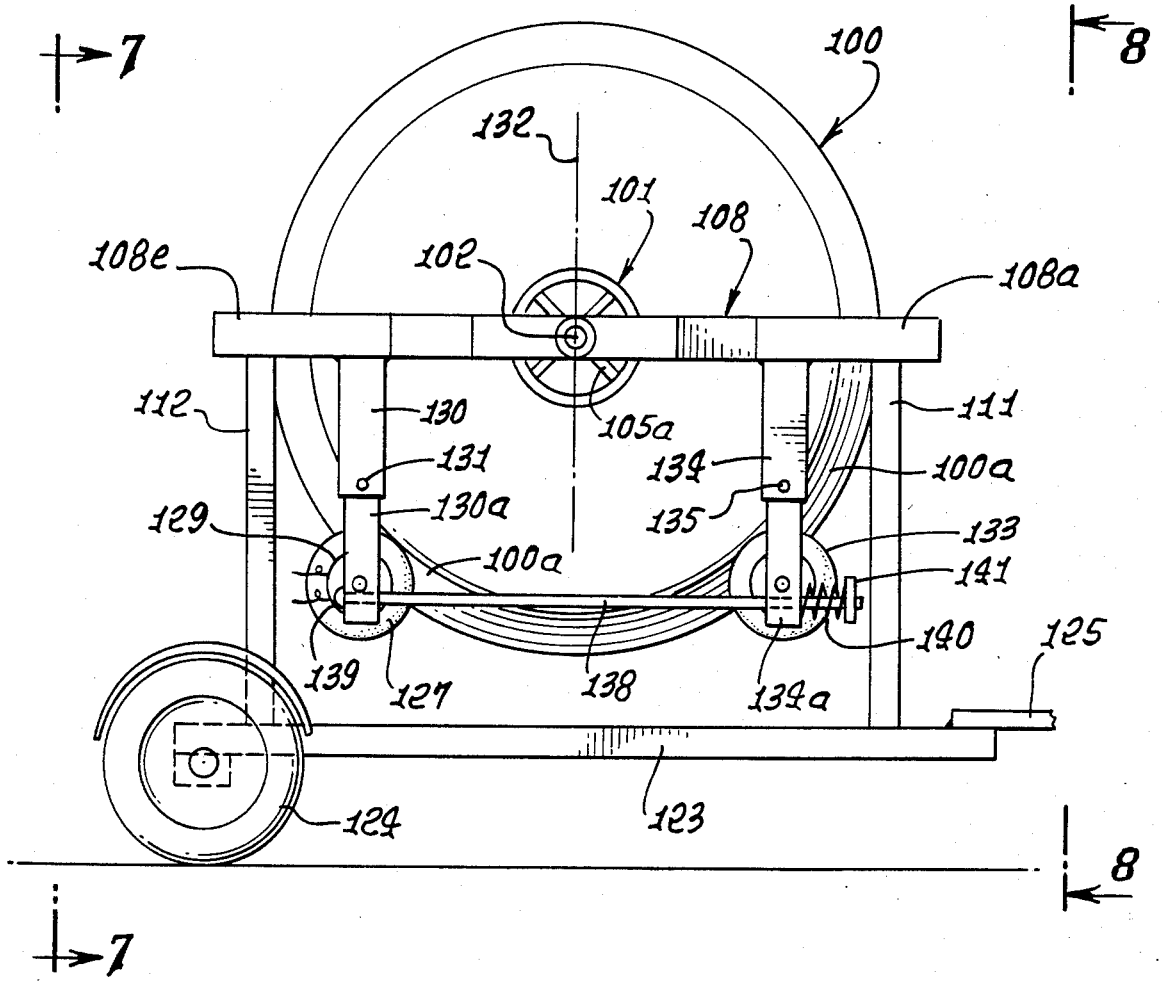
FIG. 6 is a side elevation on lines 6—6 of FIG. 5.
Figure 7:
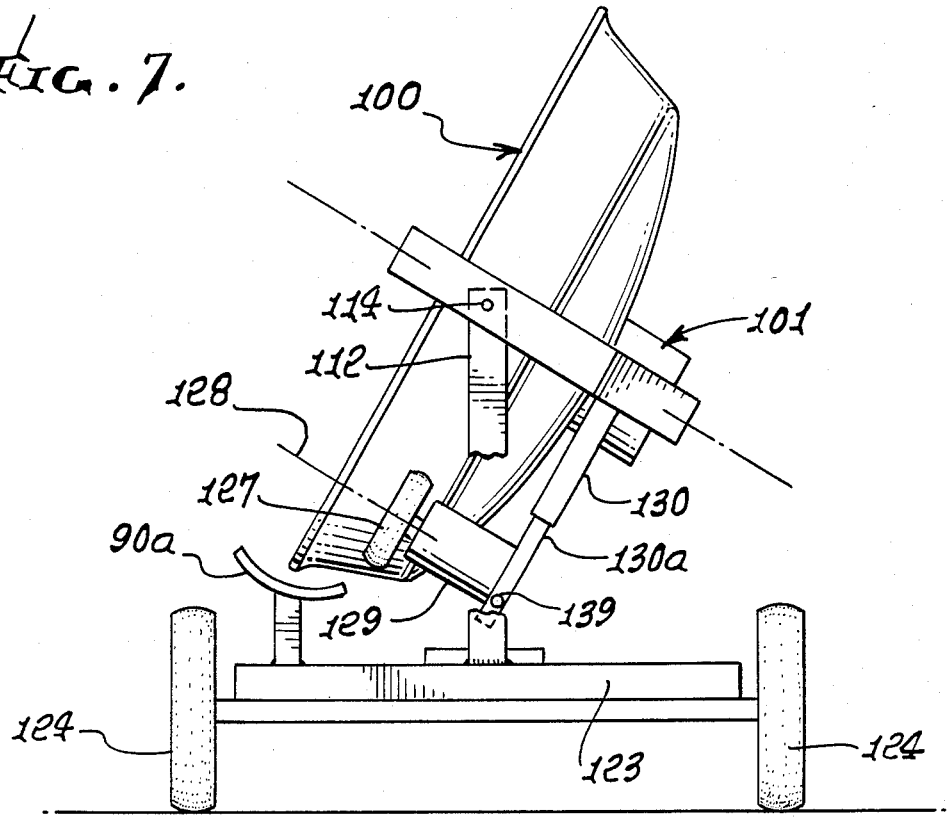
FIG. 7 is an end elevation on lines 7—7 of FIG. 6, but showing the bowl tilted.

As described in U.S. Pat. No. 4,389,308, ore separation apparatus includes a rotatable bowl 10 having an inner liner 11 of spiral grooves or riffles and a central outlet of opening 12 for discharging concentrated values of the ore. The apparatus includes cylindrical hub 14 at the periphery of the central opening 12. The hub includes an inner cylinder 13 and an outer cylinder 15 which is integrally connected with a dish-shaped portion 16, the latter being connected at its periphery to frustoconical flange 18 which terminates at outwardly flaring lip 20. Inner cylinder 13 of the hub is comprised of a rigid material, such as steel, to lend structural strength and rigidity to the hub, while outer cylinder 15 is comprised of fiberglass as is the dish-shaped portion 16 of the bowl. The inner cylinder 13 is sized to fit snugly within the outer cylinder, and the two are locked together against rotational or longitudinal slippage by means of set screw 21, as shown in FIG. 4.

Figure 2:
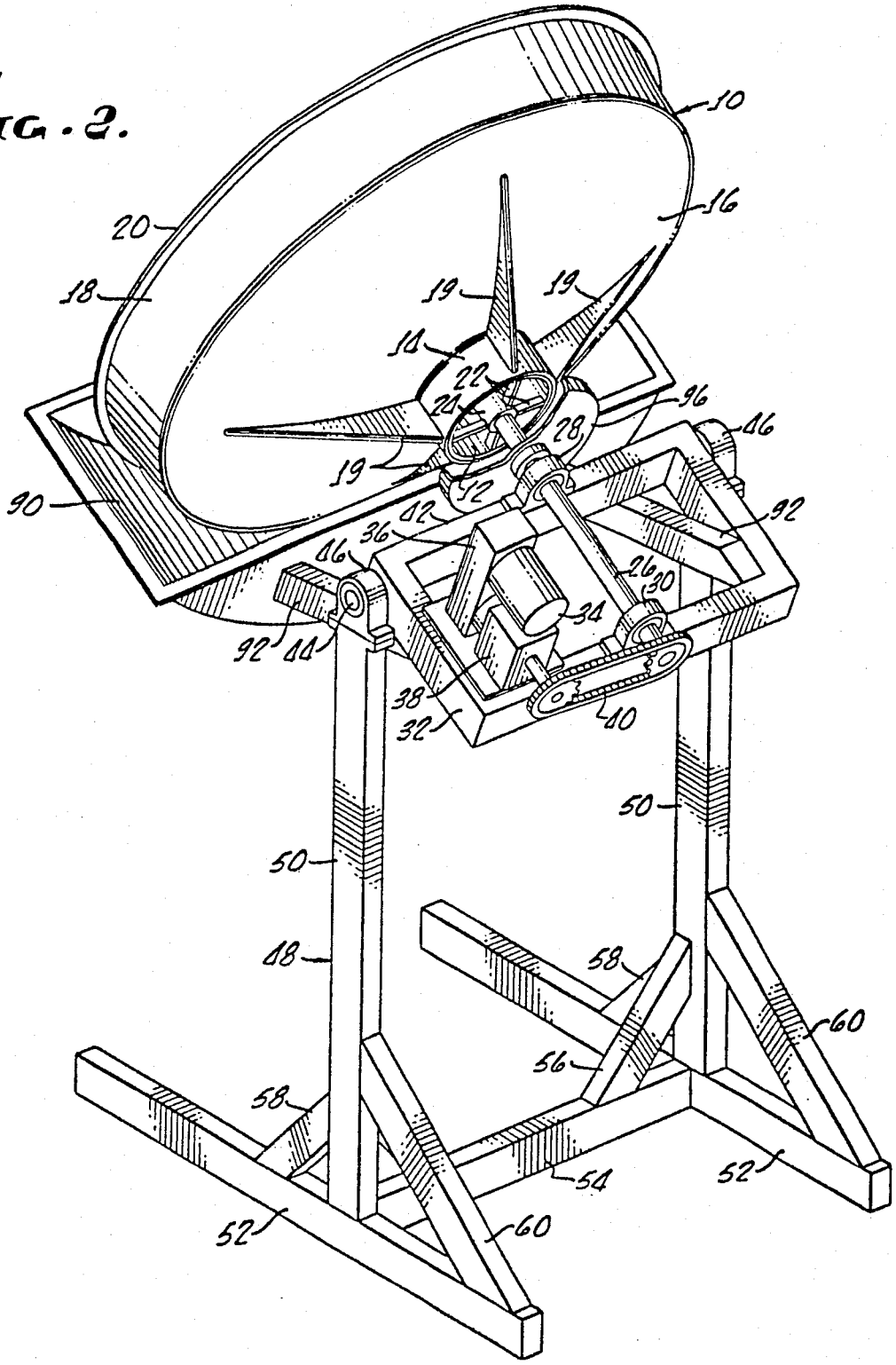
FIG. 2 shows a rear perspective view of the FIG. 1 apparatus.

A series of radially extending stiffening ribs, also comprises of fiberglass, are integrally formed and joined with the outer surfaces of outer cylinder 15 and dish-shaped portion 16 of the bowl 10, as shown in FIG. 2. These ribs serve the dual function of strengthening both the bowl and the hub against both torsional and lateral deformation when heavy loads of ore are in the bowl.

A spider means or series of ribs 22 are provided to connect the interior of hub 14 with a central mounting sleeve 24, which is pinned to drive shaft 26 by means of pins 25. Preferably, two sets of ribs 22 radiate outwardly from mounting sleeve 24 at longitudinally spaced apart positions, as shown in FIG. 4. Preferably, at least three ribs, and, more preferably, at least four ribs, are provided near each end of hub 14. By constructing the inner cylinder 13, the ribs 22, and the central mounting sleeve 24 of a strong, rigid material, such as steel, and unitizing these components, e.g., by welding, an exceptionally durable and advantageous hub arrangement can be achieved.

The drive shaft 26 is positioned within sleeve 24 a predetermined distance by means of collar 27, and is rotatably mounted by means of forward bearing 28 and rear bearing 30 on table 32. Table 32 also supports a drive motor 34, transmission means 36, gear box 38, and gear means 40 for rotating drive shaft 26 and bowl 10 in a clockwise direction, as viewed in FIG. 1.

The table 32 is equipped along its forward portion 42 with traverse axles or journals 44 for pivotally mounting the table in bearings 46. The bearings 46 are mounted upon table support 48 which is comprised of a pair of vertical stanchions 50 and longitudinal runners 52, which are connected by transverse member 54 and braced by transverse braces 56, forward braces 58, and rear braces 60.

The axis of rotation of bowl 10 is generally at a low acute angle to the horizontal, but it may be controlled and varied between a substantially horizontal position and a position approaching the vertical by means, e.g., of an hydraulic control system.

Figure 1:
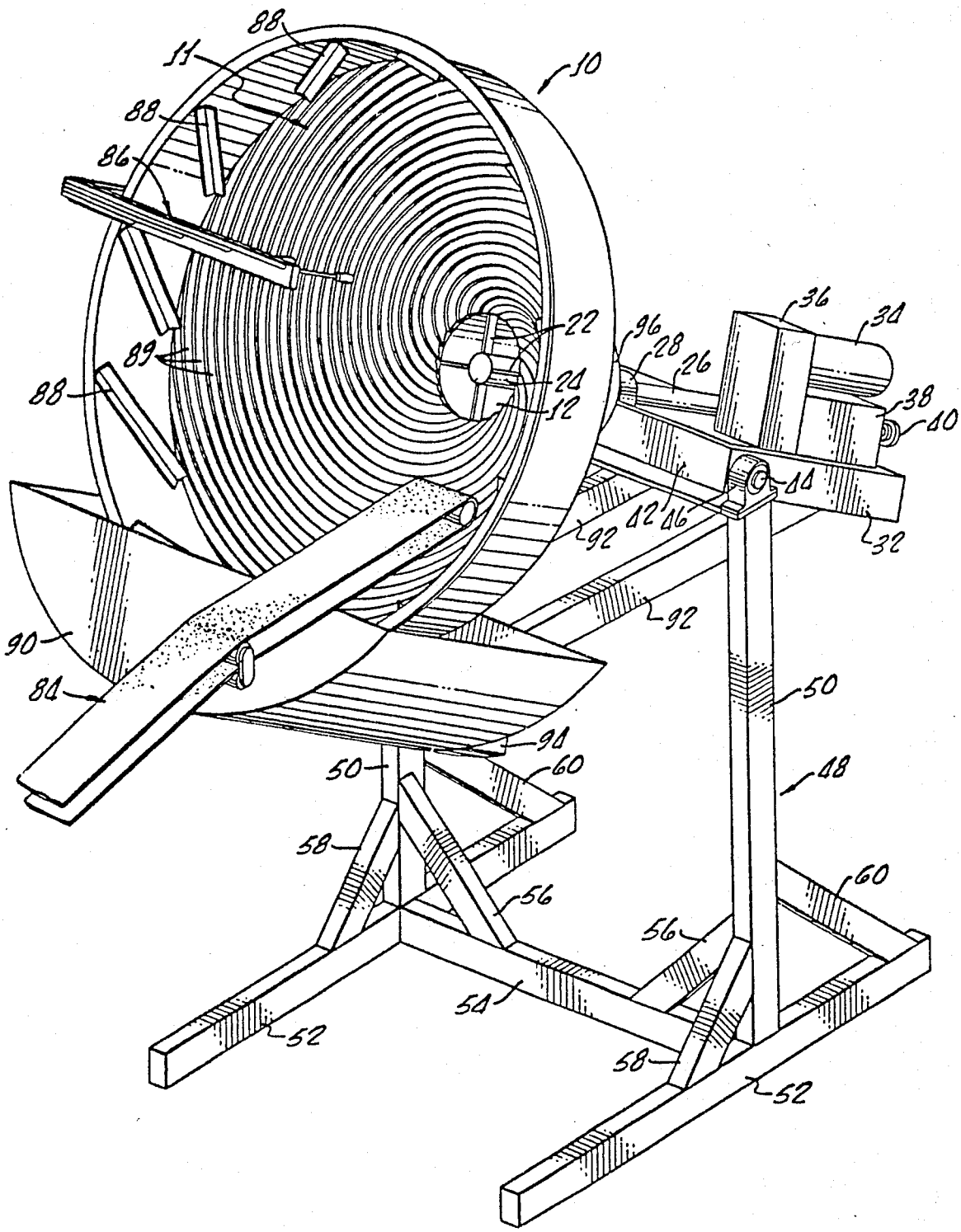

When the apparatus is used for separating ore, the drive shaft 26 is rotated by motor 34 to turn the bowl 10 in a clockwise direction, as viewed in FIG. 1. Crude ore is fed into the bowl by conveyor 84 and lubricated using water spray means 86. The bowl is equipped with mixing vanes 88 which aid in the distribution and mixing of the ore and water. As the bowl rotates, heavy ore values migrate through spiral grooves 89 to the central opening 12 of the bowl. The spiral grooves 89 (constructed, for example, of rubber) are formed as a part of liner 11, which is secured to the inside of the dish-shaped portion 16 of the bowl.

Waste material or gangue is discharged at the lower periphery of the bowl into trough 90, or a chute, which is mounted on support members 92. The support members 92 are connected rigidly to table 42 to pivot therewith.

Waste material from the trough 90 is discharged continuously through trough outlet 94 where it may be disposed of (by means not shown). The concentrated ore which leaves the bowl through central opening 12 is received or controlled by concentrated ore receptacle 96 from which it is discharged downwardly and caught in containers or receptacles (not shown), or another bowl.

When large loads of ore are fed into the apparatus, very high bending stresses are imposed upon both the bowl and the hub, especially when the axis of rotation of the bowl and hub is maintained at a desirable acute angle to the horizontal. This is aggravated further when very large containers are used, such as those seven or more feet in diameter. By employing at least three, and, preferably, four or more, stiffening ribs 19 radiating outwardly from the outer fiberglass cylinder 15 of the hub 14 and along a major portion of the radius of the bowl-shaped container, excessive deformation of the bowl is prevented. At the same time, tearing or bending of the outer cylinder 15 of the hub is prevented by the stiffening effect of ribs 19, together with the backing provided internally by the rigid cylinder 13. The series of spokes 22 enable the hub and container to maintain their predetermined axial alignment with drive shaft 26.

Figure 3:
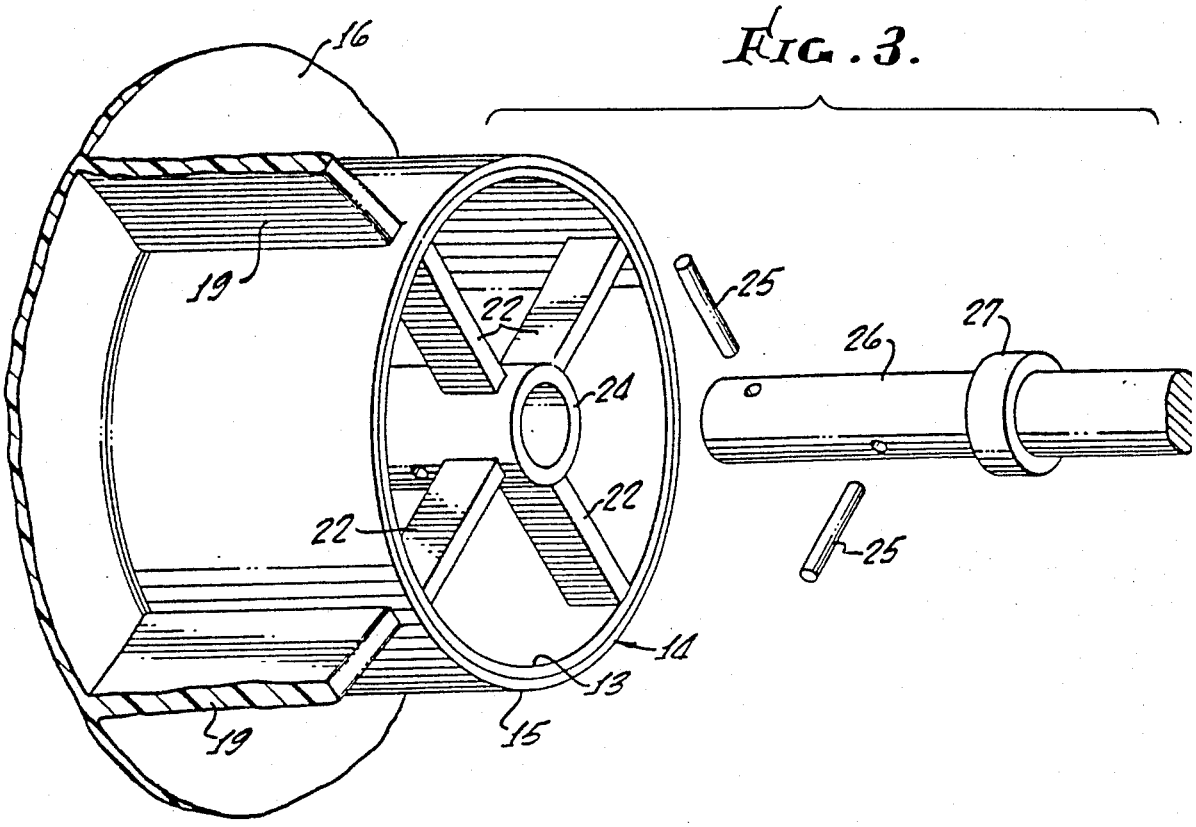
FIG. 3 is an exploded fragmentary perspective of the FIG. 1 apparatus hub and drive shaft.

Referring now to FIGS. 5–8, the bowl or container 100 itself may have the same construction as bowl 10. It also includes the ring or annular hub structure shown in FIGS. 3 and 4, and indicated generally at 101. The bowl first axis of rotation is shown at 102, and is defined by structure 103, as for example a shaft, which extends forwardly to bearing 104 and rearwardly to bearing 105. Thus, the shaft is supported at both ends, and in turn supports the ring or hub 101 via webs 105*a*. A frame 106 includes a front horizontal beam 107, and a rear beam 108 having sections 108*a*—108*e*. Bearings 104 and 105 are carried by beams 107 and 108, as shown. The latter are connected by side beams 109 and 110 at the periphery of the bowl.

Figure 8:
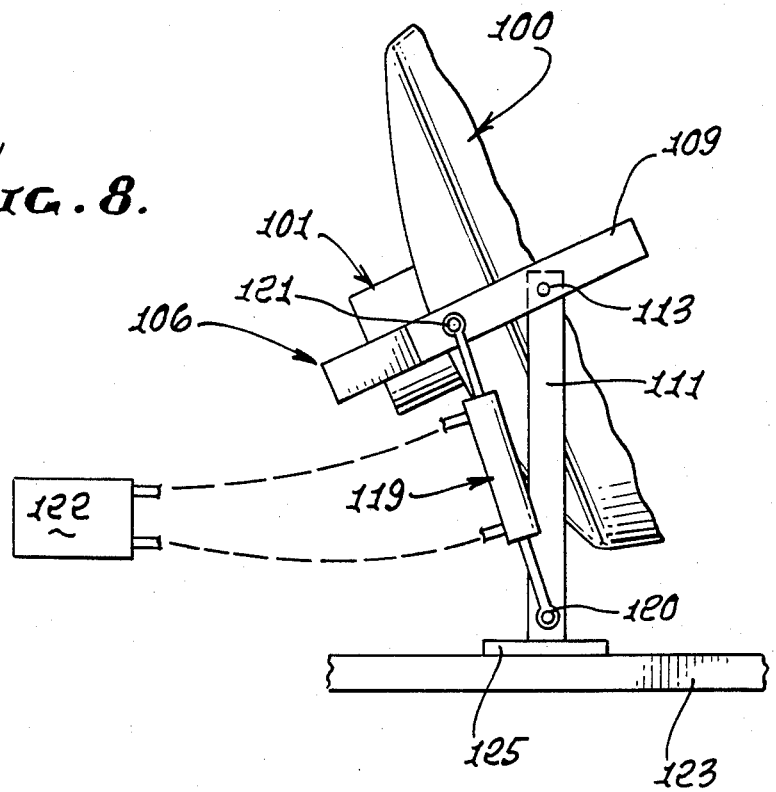
FIG. 8 is an end elevation on lines 8—8 of FIG. 6, the bowl being tilted.

Vertical uprights 111 and 112 are connected with side beams 109 and 110 via pivots 113 and 114 defining a second axis 115. FIG. 8 shows an hydraulic actuator 119 interconnected at 120 and 121 between upright 111 and frame side beam 109 whereby the bowl is mounted for selective tilting about horizontal second axis 115. Note hydraulic fluid pressure control 122, for controlilng the actuator. Uprights 111 and 112 may be connected to a base frame 123, which may be supported on wheels 124 thereby to provide trailer support for the bowl, adapted to be towed to ore separation sites as via tongue 125 and towing vehicle (not shown).

Also provided is drive means including a drive rotor suspended by the frame, and engaging an outer annular surface 100*a* of the bowl, for rotating the bowl. Surface 100*a* faces laterally outwardly, away from axis 102. One such drive roller is shown at 127, having an axis 128 of rotation parallel to axis 102. The roller 127 is driven by a prime mover or motor 129 which may be hydraulically or electrically operated, for example. Motor 129 is shown as also suspended from the frame, an auxiliary member 130 being attached to frame section 108*e* and suspending both the roller 127 and the motor 129 via a head 130*a*. The latter is advantageously articulated, as by pivoted connection at 131 to member 130 whereby the head 130*a* swings in a plane parallel to the plane of FIG. 6, toward and away from a vertical plane 132 that contains axis 102 and bisects the bowl.

In similar manner, an idler roller 133 is suspended to engage the bowl outer surface, i.e. the same rotating annular surface 100*a* that is engaged by roller 127. A second auxiliary member 134 is attached to frame section 108*a*, and suspends roller 133 and mount 136 via a head 134*a*. The latter is advantageously articulated as by pivoted connection at 135 to member 134, whereby head 134*a* swings laterally toward and away from plane 132. The forwardly projecting roller mount 136 including an axle, is connected to the bottom end portion of head 134*a*, as shown.

It is a feature of the invention that the two rollers 127 and 133, symmetrically located at opposite sides of plane 132, and symmetrically supported by articulated head 130*a* and 134*a*, act also to exert support forces on the underside of the bowl. To this end, the members 130 and 134 may advantageously be interconnected as for example by a connecting rod 138, so as to resist relative spreading of the two rollers 127 and 133. Rod 138 is shown as flexibly connected at 139 to member 130, and as extending through member 134*a*. A compression spring 140 is positioned between the outer side of member 134 and a stop 141 on the end of the rod, whereby the spring forcibly urges the rollers toward one another and against the bowl surface 100*a*, whereby roller 127 may drive the bowl in rotation, and both rollers may exert supporting forces on the underside of the bowl, whereby the loading on shaft 103 is correspondingly reduced, the bowl having three point suspension aiding its operation. Stop 141 may be threaded to the shaft so as to variably tension the spring 140, whereby the forces exerted by the rollers on the bowl are adjustable, within limits. Also the rollers may skid relative to the bowl, without damage; and drive torque is minimized due to drive roller locations.

Wheels 124 may be removed at a work site.

Figure 9:
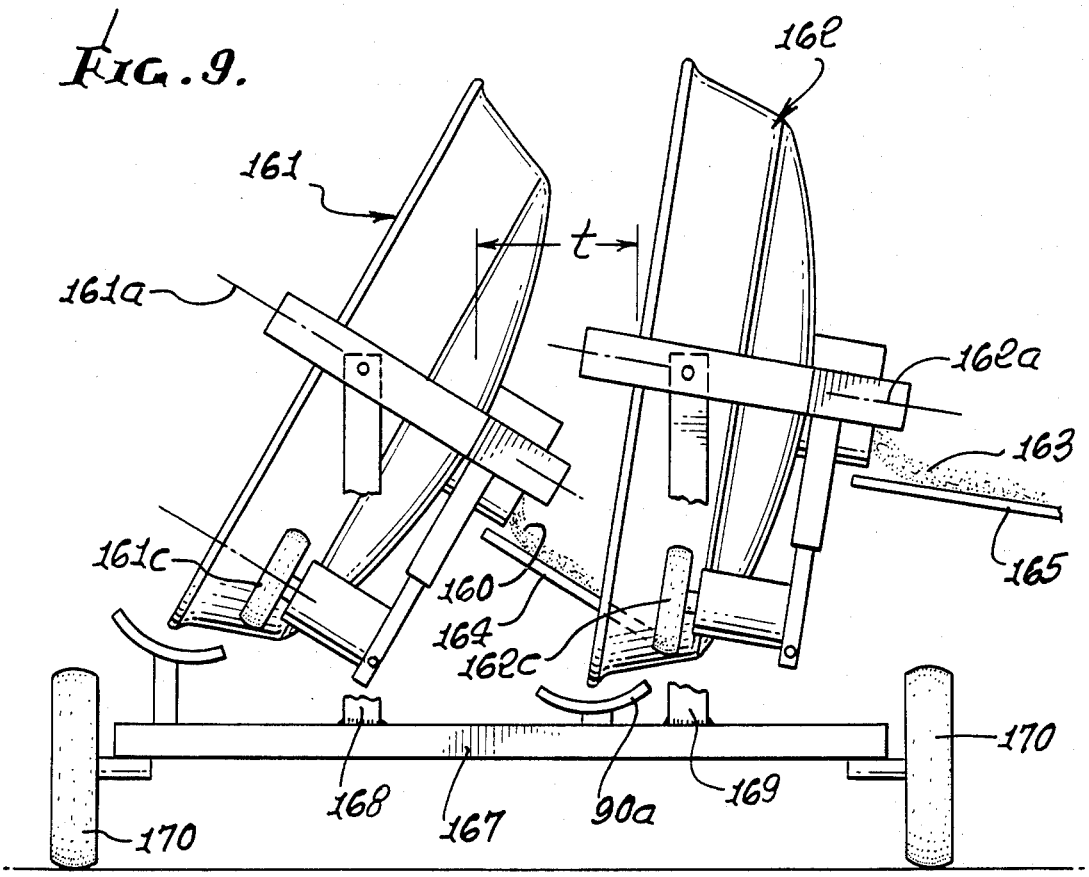
FIG. 9 is a view like FIG. 7, showing multiple bowls, operating as a system.
Figure 10:
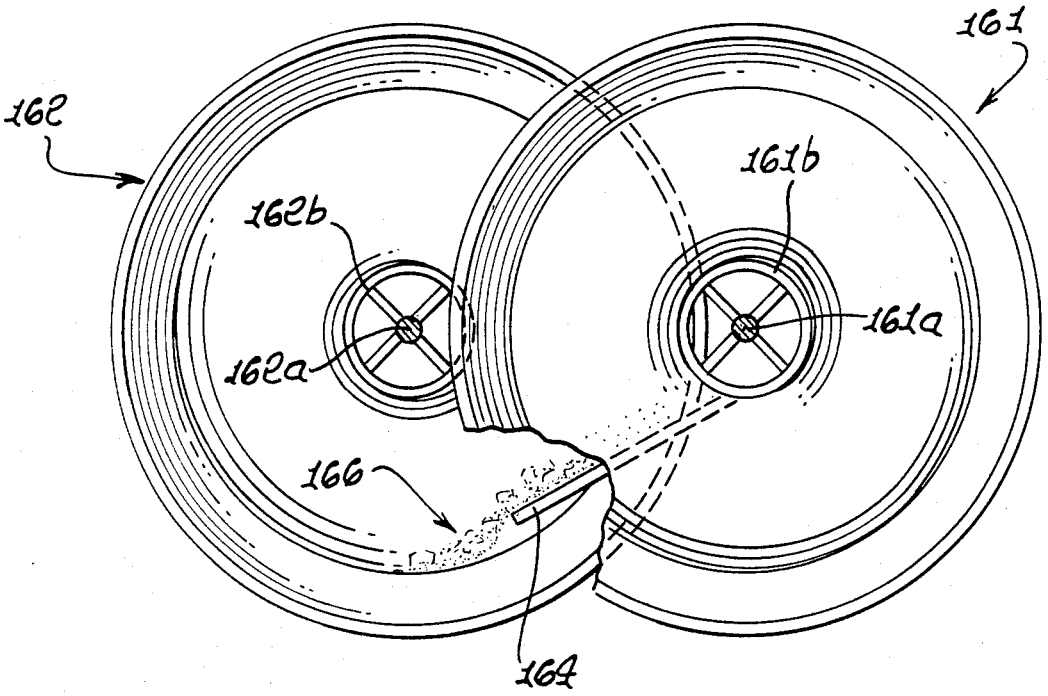
FIG. 10 is a schematic front elevation showing lateral offsetting of the FIG. 9 bowls.

FIGS. 9 and 10 show two bowls (like bowls 100) which are alike, and mounted to operate in close tandem, i.e. the concentrate 160 from the first bowl 161 is directly discharged into the open interior of the second bowl 162, for further processing to discharge at 163 as much richer concentrate. Suitable chutes 164 and 165 are provided. The two bowls are independently tiltable, and typically the second bowl 162 has less tilt than the first. FIG. 10 shows the two bowl axes (the bowls are here shown vertically oriented, prior to tilting) 161*a* and 162*a* as offset from one another, which enables location of the bowls in closely spaced front to rear relation, whereby the first bowl may directly discharge into the side of center 166 location of the second bowl, for efficient processing of ore. Note bowl discharge rings 161*b* and 162*b* corresponding to ring 101 in FIG. 5. The spacing "t" between the two bowls, in vertically oriented positions, is enabled to be substantially less than their diameters, as further facilitated by the peripheral roller drives and tilt mechanisms, as described in FIGS. 5–8. See drive rollers 161*c* and 162*c*, corresponding to roller 127 in FIG. 7. A base 167 supports the bowl from uprights 168 and 169, and wheels 170 may be provided on the base, for transportation.

Figure 11:
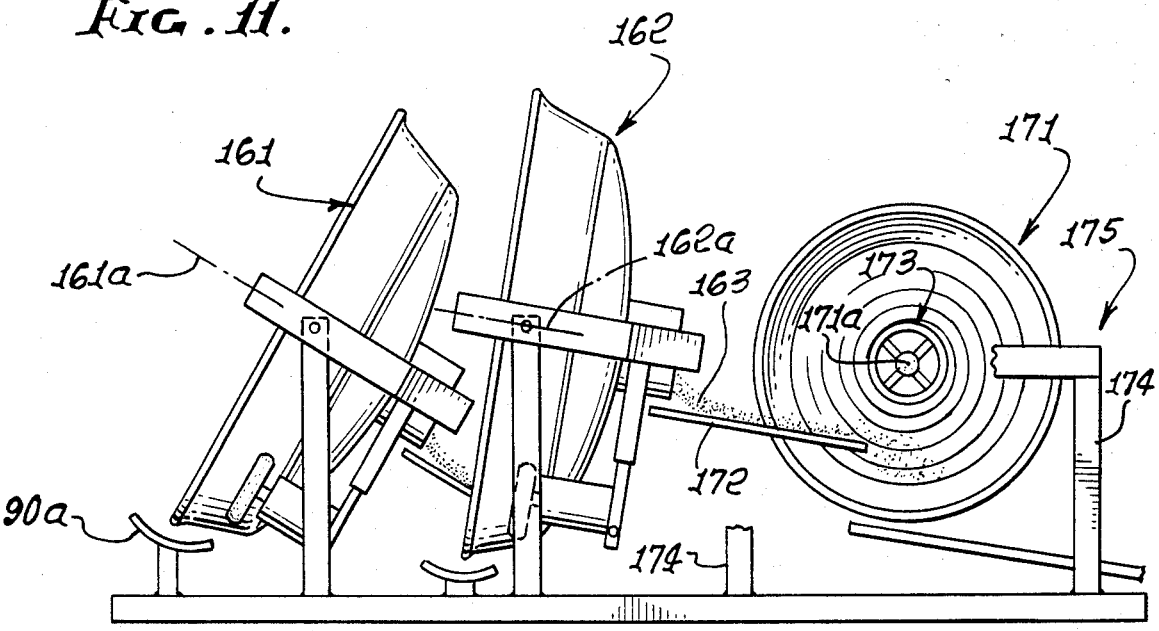
FIG. 11 is a view like FIG. 9, showing addition of a third bowl.

FIG. 11 shows a third bowl 171, of smaller diameter, receiving (via chute 172) the concentrate 163, for further processing to achieve very rich concentrate discharge via its discharge ring 173. Note that the rotary axis 171*a* of bowl 171 extends generally laterally, whereas the axes 161*a* and 162*a* of bowls 161 and 162 extend generally longitudinally. Upright 174 support the frame 175 of bowl 171.

Figure 12:
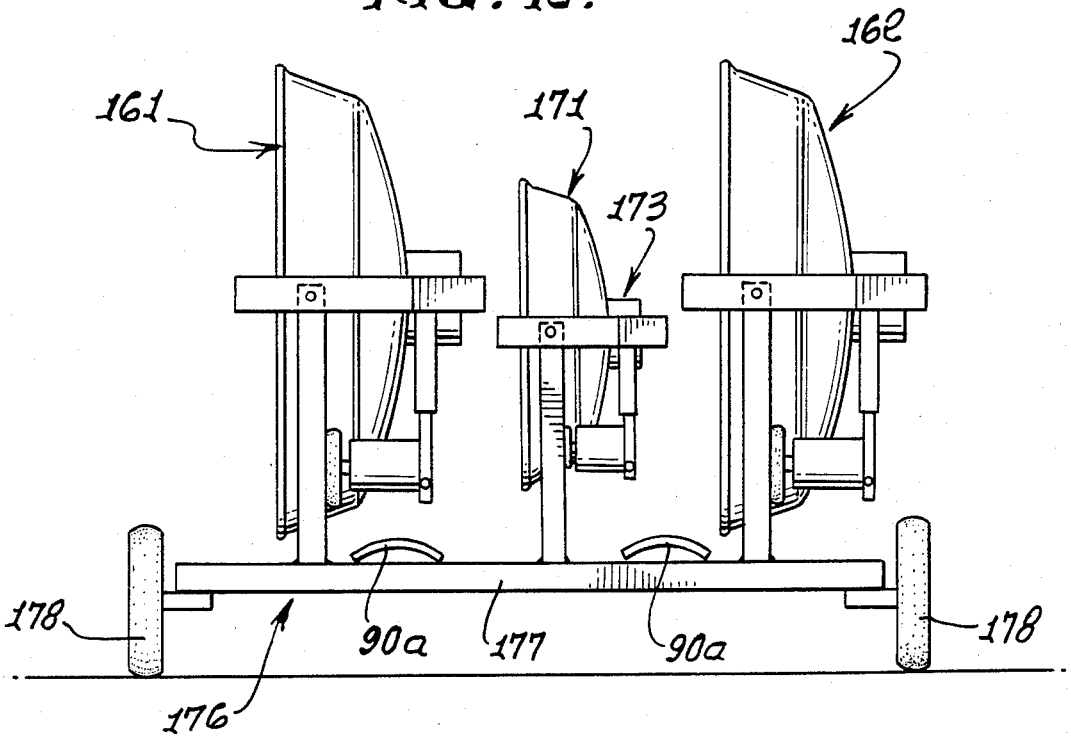
FIG. 12 is an elevation showing the packed bowl transport.

FIG. 12 shows all three bowls 161, 162 and 171 close packed, in a trailer 176, for transportation. The small bowl is located between the two larger bowls. Trailer frame and wheels appear at 177 and 178.

Chutes 90*a* are removably supported, as shown at 92 in FIG. 9.

Offsetting of bowls 161 and 162 in FIG. 10 enables good visibility of the interiors of both bowls as they rotate; enables water feeding to both bowls; and enhances compactness of the assembly.

I claim:

1. In apparatus of the character described, the combination comprising (a) first and second rotary bowls each having rotary surfaces for separating particles of ore received into the bowls, each bowl having an axis of rotation, the bowls mounted for selective and independent tilting of said axes, both bowls facing generally frontwardly, (b) the second bowl having an open interior portion thereof openly facing toward a portion of the rear of the first bowl, with said axes offset from one another, the bowls located in closely spaced relation with the first bowl having a rearward discharge opening in particle discharge communication with said open interior portion of the second bowl, (c) and including, for each bowl, drive means including a drive rotor suspended to engage the bowl outer surface facing away from said axis for rotating the bowl, a prime mover operatively connected with said drive rotor, and and idler roller engaging said bowl outer surface, said idler roller and said drive rotor being located to exert supporting forces on the underside of the bowl at opposite side of a vertical plane bisecting the bowl, said plane containing said axis of rotation, (d) and including two heads respectively suspending said drive means and said idler roller, and including support means supporting the bowl for rotation and tilting, and carrying said heads.

2. The apparatus of claim 1 wherein the spacing between said bowls is less than the diameter of the second bowl.

3. The apparatus of claim 1 wherein the tilt of the first bowl from vertical substantially exceeds the tilt of the second bowl, from vertical.

4. The combination of claim 1 wherein said support means for each bowl includes uprights at opposite sides of the bowl, a frame supported by said uprights, the frame extending at the front and rear of the bowl, and structure extending through the bowl and connected with the frame at the front and rear of the bowl, there being a discharge ring at the rear of the bowl and connected therewith, said structure connected with said ring, said ring defining said discharge opening.

5. The combination of claim 4 wherein said support means includes auxiliary supports carrying said heads, said auxiliary supports suspended by said frame.

6. The combination of claim 4 including a carrier frame for said uprights, and wheel means supporting said carrier frame for transportion thereof.

7. The combination of claim 4 including an hydraulic actuator operatively coupled between an upright and the frame to tilt the frame and bowl.

8. The combination of claim 1 wherein first bowl is tilted from vertical to substantially greater extent than the second bowl.

9. In apparatus of the character described, the combination comprising (a) first and second rotary bowls each having rotary surfaces for separating particles of ore received into the bowls, each bowl having an axis of rotation, the bowls mounted for selective and independent tilting of said axes, both bowls facing generally frontwardly, (b) the second bowl having an open interior portion thereof opening facing toward a portion of the rear of the first bowl, with said axes offset from one another, the bowls located in closely spaced relation with the first bowl having a rearward discharge opening in particle discharge communication with said open interior portion of the second bowl, (c) and including a third ore concentrating rotary bowl having an axis of rotation which extends generally sidewardly and opening toward a region immediately rearwardly of the second bowl, said third bowl also having rotary surfaces for separating of ore received into the open interior thereof.

10. The apparatus of claim 9 wherein the third bowl is mounted for selective and independent tilting of said axis thereof, the diameter of the third bowl being substantially less than the diameter of the first and second bowls.

11. The apparatus of claim 10 including a support structure for all three of said bowls.

12. The apparatus of claim 9 including means for rotating said first and second bowls by transmitting rotary force to outward peripheries thereof.

13. The apparatus of claim 9 including, for each of the first and second bowls, drive means including a drive rotor suspended to engage the bowl outer surface facing away from said axis for rotating the bowl, and a prime mover operatively connected with said drive rotor.

14. The combination of claim 13 including second support means carrying said drive means to pivot relative to said bowl outer surface, said second support means carried by said first support means.

15. The combination of claim 13 including an idler roller suspended by said first support means and engaging said bowl outer surface, said idler roller and said drive rotor being located to exert supporting forces on the underside of the bowl at opposite side of a vertical plane bisecting the bowl, said plane containing said first axis, said second axis extending generally horizontally.

16. In apparatus of the character described, the combination comprising (a) first and second rotary bowls each having rotary surfaces for separating particles of ore received into the bowls, each bowl having an axis of rotation, the bowls mounted for selective and independent tilting of said axes, both bowls facing generally frontwardly, (b) the second bowl having an open interior portion thereof openly facing toward a portion of the rear of the first bowl, with said axes offset from one another, the bowls located in closely spaced relation with the first bowl having a rearward discharge opening in particle discharge communication with said open interior portion of the second bowl, (c) and including, for each bowl, drive means including a drive rotor suspended to engage the bowl outer surface facing away from said axis for rotating the bowl, a prime mover operatively connected with said drive rotor, and an idler roller engaging said bowl outer surface, said idler roller and said drive rotor being located to exert supporting forces on the underside of the bowl at opposite sides of a vertical plane bisecting the bowl, said plane containing said axis of rotation, (d) and including support means provided for each bowl to include uprights at opposite sides of the bowl, a frame supported by said uprights, the frame extending at the front and rear of the bowl, and structure extending through the bowl and connected with the frame at the front and rear of the bowl, there being a discharge ring at the rear of the bowl and connected therewith, said structure connected with said ring, said ring defining said discharge opening, (e) there being auxiliary support means carrying said drive means and said idler roller, said auxiliary means suspended by said frame, said auxiliary support means including two heads respectively suspending said drive means and said idler roller.

17. The combination of claim 16 including a connection interconnecting said two heads to resist relative spreading of said drive roller and idler roller.

18. The combination of claim 17 including a spring cooperating with said connection to yieldably resist relative spreading of said rollers.

19. The combination of claim 17 wherein said rollers are suspended, via said heads to pivot toward and away from said bowl outer surface.

20. The combination of claim 17 wherein said heads are articulated whereby said rollers are movable toward and away from said bowl outer surface.

21. Ore separation apparatus comprising two structures, each including a rotatable container having a concave portion with an opening for discharging concentrated ore at its center, an elongated cylindrical hub, one end of which abuts said container and circumscribes said opening to pass said concentrated ore, the hub mounting the container, an elongated shaft substantially smaller in cross section than said opening, said shaft having one end portion centered within said hub and extending outwardly therefrom, and spider means connecting the shaft to the interior of said hub, whereby the hub is mounted to the shaft so that the entire weight of the container is transmitted via the hub to the shaft end portion, said concave portion of said container facing away from said hub, and said shaft being axially aligned therewith, tilting structure operatively connected with the shaft via which bowl weight is transmitted to said tilting structure, and drive means operatively connected to the container via said tilting structure, said two structures positioned so that the respective containers are located fore and aft to both open generally forwardly, the aft container offset sidewardly relative to the fore container, the fore container discharge opening being in communication with the aft container to deliver concentrated ore thereto.

* * * * *